US005094344A

United States Patent [19]

Savage

[11] Patent Number: 5,094,344

[45] Date of Patent: Mar. 10, 1992

[54] SURFBOARD CARRY CASE

[76] Inventor: James A. Savage, 140 N.E. 56th St., Fort Lauderdale, Fla. 33334

[21] Appl. No.: 724,116

[22] Filed: Jul. 1, 1991

[51] Int. Cl.[5] ..... B65D 85/00; B65D 85/30

[52] U.S. Cl. ..... 206/315.1; 206/523; 206/589; 206/592; 441/74

[58] Field of Search ..... 206/315.1, 523, 588, 206/589, 590, 592; 441/74, 125

[56] References Cited

U.S. PATENT DOCUMENTS

| | | | |
|---|---|---|---|
| 3,287,754 | 11/1966 | Price et al. | 441/74 |
| 3,339,607 | 9/1967 | Howard | 206/315.1 |
| 4,483,380 | 11/1984 | Beran | 206/315.11 |
| 4,719,952 | 1/1988 | Geronimo | 441/74 X |
| 5,033,497 | 7/1991 | Hernandez | 206/315.1 X |

FOREIGN PATENT DOCUMENTS

| | | | |
|---|---|---|---|
| 3225842 | 2/1984 | Fed. Rep. of Germany | 206/523 |

*Primary Examiner*—Bryon P. Gehman

*Attorney, Agent, or Firm*—Malloy, Downey & Malloy

[57] ABSTRACT

A carry case, including a flexible, soft portion and a rigid, hard portion for transporting a surfboard therein so as to prevent damage to the surfboard's fins. The carry case is structured such that at least one surfboard can be carried therein, with a tail portion of the surfboard, including the fins, protectively encapsulated within the hard case portion, thereby preventing damage thereto due to impact and mishandling of the case during transport.

8 Claims, 3 Drawing Sheets

SURFBOARD CARRY CASE

FIELD OF THE INVENTION

The present invention is directed to a carry case for carrying a surfboard therein during transport in such a manner so as to protect the surfboard's fins from damage due to shock, impact, and mishandling during shipment.

BACKGROUND OF THE INVENTION

Many of today's avid surfers travel to various locations around the globe to enjoy surfing at some of the world's best locations. Additionally, when traveling for business or pleasure to locations where surfing is particularly good,. many surfers like to bring their surfboard along on the trip so that they can take advantage of the opportunity to surf at new locations. When transporting a surfboard, usually on an airline, it is necessary to package the surfboard in some type of protective cover to shield the somewhat delicate surfboard from damage resulting from shock and impact normally encountered during transport on an airline's luggage system.

Presently, most surfboards are transported in soft carry cases having a nylon outer shell and inner lining with a thin layer of foam sandwiched therebetween to absorb low impact. There are also hard cases which are structured to provide a protective shell about the surfboard. While hard cases are than the surfboard to be carried therein. The size of hard cases makes it hard to store them during non-use and therefore, they are not as desirable as a soft case which can be folded and stored in a car trunk or roof rack.

While the carry cases well-known in the art are somewhat effective in protecting against dents and other damage due to impact to the surfboard, none of the carry cases in the present art are effective in preventing damage to the surfboard's fins and tail portion, while also being suited for easy storage during non-use. Often, surfboards transported in the soft cases have their fins broken off due to mishandling including placing other heavy luggage on top of the tail portion of the surfboard. Because the fins are usually integrally formed with the tail portion of the surfboard out of fiberglass, it doesn't take much of a force to break them off.

In an attempt to eliminate the problem of damage to the surfboard's fins during transport, several products have been developed including a pillow or air bag which straps onto the tail portion of the board and includes slots for the fins to extend into so as to be shielded from direct impact. While these devices are somewhat effective, they are not adequate to protect the fins and tail portion of the surfboard from a substantial direct impact which would result in, forcing the airbag to move relative to the surfboard thereby damaging, and possibly breaking off the fins.

Included in the related art are the patents to Beran, U.S. Pat. No. 4,483,380 and Geronimo, U.S. Pat. No. 4,719,952. The patent to Beran discloses a foldable protective cover and carrier for sports equipment including surfboards. The protective cover disclosed in Beran completely covers the surfboard and is somewhat effective in protecting the board from low impact forces which could result in scratching or denting the board. However, the Beran protective cover does not provide a solution to the problem of damage to the surfboard's fins during transport. Geronimo discloses a temporary shock-absorbing cover for protecting the delicate tips and horizontal control edge surfaces of a surfboard. The cover is essentially a resilient, shock-absorbent material which fits around the peripheral edges of the surfboard. However, Geronimo does not address the problem of damage to the surfboard's fins which is the most common source of damage experienced during transport.

Accordingly, with the foregoing in mind, it is an object of the present invention to provide a carry case for carrying a surfboard therein during transport wherein the carry case is specifically structured to protect the fins and tail portion of the surfboard from damage due to shock, high impact and general mishandling during shipment.

It is a further object of the present invention to provide a surfboard carry case which includes a flexible, soft portion and a substantially rigid, hard portion integrally connected with the soft portion so as to include a common interior compartment wherein a surfboard carried therein will be oriented with its tail portion and fins protectively encapsulated within the hard portion of the case.

It is a further object of the present invention to provide a surfboard carry case which includes a hard shell portion adapted to protectively encapsulate the fins and tail portion of the surfboard yet still permitting the case to be at least partially collapsed for convenient storage during periods of non-use.

It is another of the present invention to provide a surfboard carry case which includes a hard shell adapted to protectively encapsulate the fins of the surfboard while being substantially lightweight and easy to handle.

It is yet a further object of the present invention to provide a surfboard carry case which is adapted to protect both the forward portion of the surfboard from impact which could result in scratches and dents thereto and the tail portion of the surfboard including the fins, wherein the tail end fins are completely shielded and protected from direct impact.

Moreover, it is a further object of the present invention to provide a surfboard carry case for protecting the nose, forward portion, tail portion and fins of a surfboard during transport wherein the carry case can be stored conveniently in a minimum of space when not in use.

SUMMARY OF THE INVENTION

The present invention is directed to a surfboard carry case which is adapted to contain at least one surfboard therein during transport so as to effectively protect the surfboard, including the tail portion and fin thereof, from shock, impact, and general mishandling which ordinarily results in substantial damage to the surfboard and especially the fins. The carry case includes a substantially flexible, soft portion and a substantially rigid, hard portion which are integrally attached so as to include a common interior storage compartment adapted for receipt of at least one surfboard therein. The soft portion of the case includes an upper panel and a lower panel attached to one another substantially about correspondingly peripheral edges so as to substantially surround and cover a forward portion, including a nose, of the surfboard carried within the case. The hard portion of the case consists of a top shell and a bottom shell structured and configured to receive a tail portion and the fins of the surfboard therebetween in enclosing, encapsulating, protecting relation thereto.

The bottom shell is specifically configured to accommodate for the surfboard's fins extending down from the tail portion thereof so that when the surfboard is positioned within the storage compartment of the carry case, the tail portion and fins are completely encapsulated by the surrounding top and bottom shells thereby preventing damage thereto due to shock and high impact forces delivered thereto.

In order to place and remove the surfboard from within the storage compartment, a zipper is fitted to the case and preferably extends substantially around the rearward portion thereof between the top shell and bottom shell of the hard portion so that when unzipped, the top shell is movable between an open and closed position relative to the bottom shell. By moving the top shell to the open position, the surfboard can be easily inserted so that the nose and forward portion extend through the soft portion of the case with the tail portion and fins being positioned within the hard portion of the case. A protective foam lining is preferably fitted within, the interior of the hard case portion including a substantially thick bed of foam fitted within the bottom shell having slots cut into the foam for placement of the fins therein. In this manner, relative movement of the tail portion relative to the case is eliminated, thereby preventing damage to the tail portion and fins due to excessive movement within the case.

The forward flexible, soft portion of the case preferably includes an outer nylon lining such as DuPont Nylon Codurae® and a waterproof nylon inner lining with a layer of shock-absorbent foam sandwiched therebetween. The specific structure of the flexible portion of the case protects the nose and forward portion of the surfboard from shock and normal impact encountered during transport while still allowing the soft portion to be folded over and collapsed on to the hard portion of the case thereby maximizing the storage efficiency of the case.

In an alternative embodiment of the present invention, the carry case includes two hard portions disposed at opposite ends of the case with a flexible, soft case portion extending therebetween. The carry case of the alternative embodiment includes two separate interior storage compartments wherein two surfboards can be carried in the case with the tail portion and fins of each surfboard being adequately protected within the protective shells of the hard portion.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings, in which.

Like reference numerals refer to like parts throughout the several views of the drawings.

DETAILED DESCRIPTION OF THE PREFERRED EMBODIMENT

Figure 1:
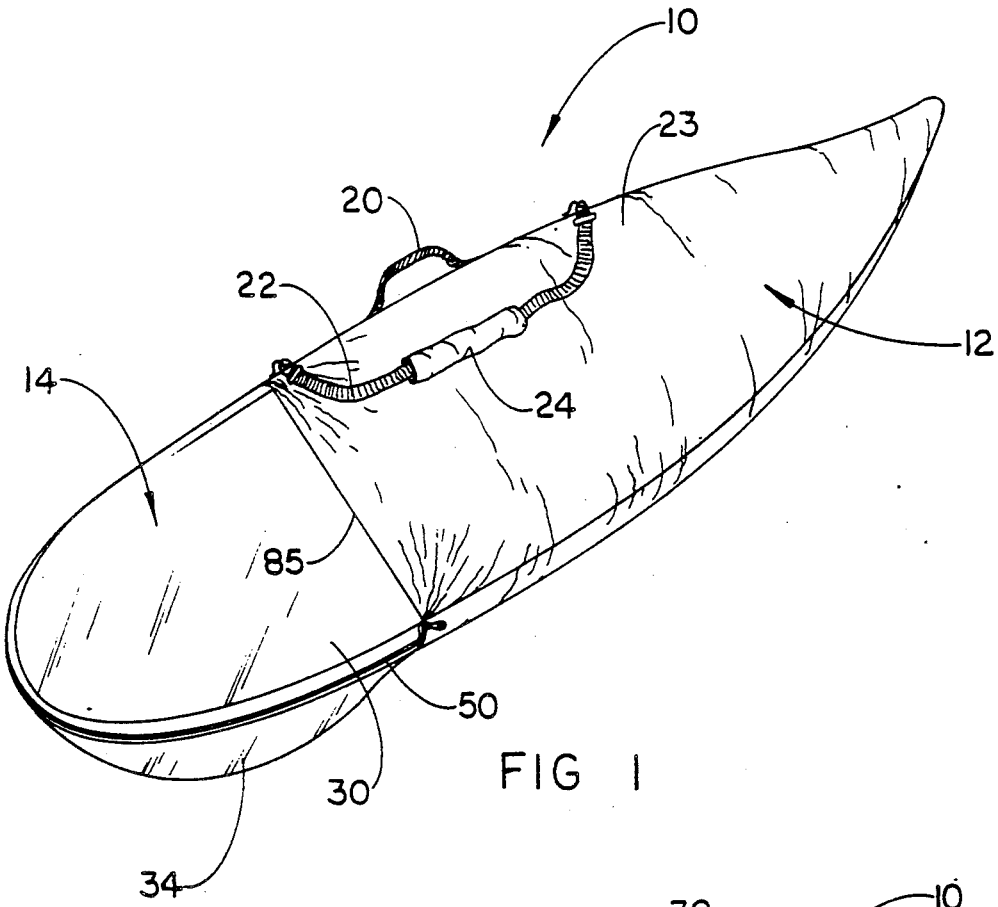
FIG. 1 is a perspective view of a preferred embodiment of the surfboard carry case.

Referring initially to FIG. 1, the present, invention is directed to a surfboard carry case, generally indicated as 10, adapted to protectively carry a surfboard therein during transport. In the preferred embodiment, the carry case 10 includes a forward flexible, soft case portion 12 and a rearward substantially rigid, hard case portion 14 integrally connected 4.

To facilitate carrying of the case, a handle 20 and shoulder strap 22 are fitted to an upper edge 23 thereof. The shoulder strap 22 includes a shoulder pad 24 which provides for a comfortable engagement on one's shoulder when supporting the load of the carry case and surfboard contained therein.

Figure 2:
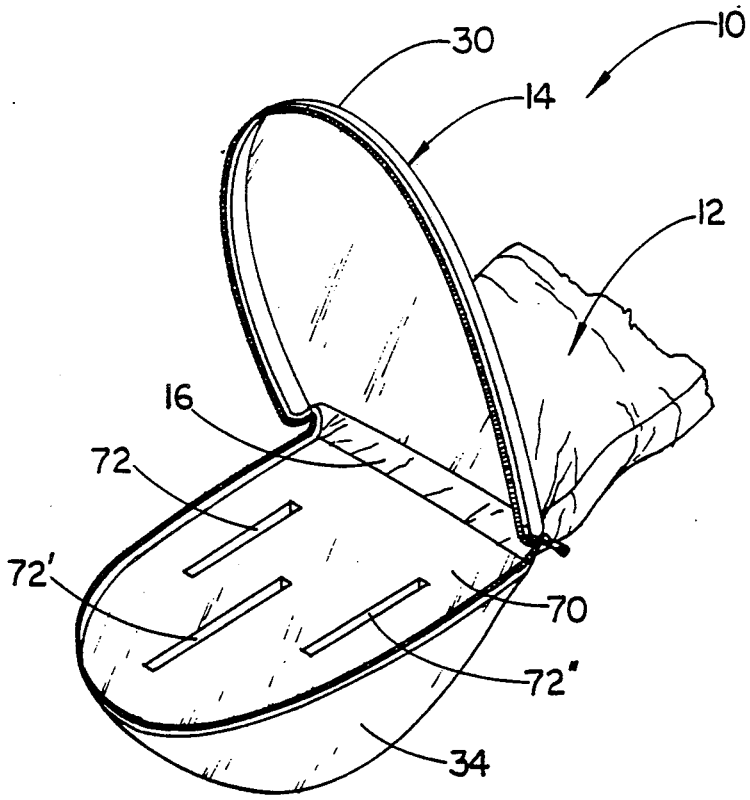
FIG. 2 is an isolated view shown in perspective of a rearward portion of the carry case including a hard portion thereof.
Figure 4:
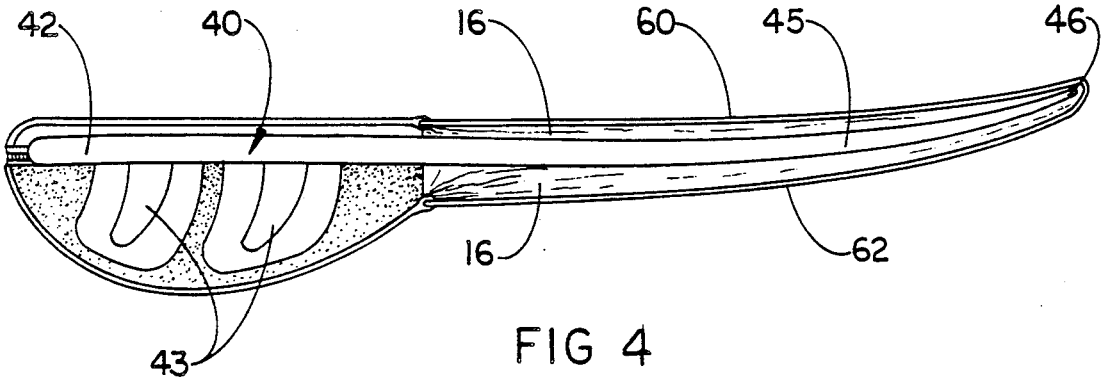
FIG. 4 is a side plan view shown in partial section illustrating a surfboard fitted within an interior storage compartment of the surfboard carry case of the present invention.

The hard case portion 14 includes a top shell 30 and a bottom shell 34 structured to receive the tail portion 42 and fins 43 of a surfboard 40 therebetween in enclosing, substantially encapsulating, protecting relation therein, as best seen in FIG. 4. Referring to FIGS. 1 and 2, an axis means and closure means of the case are illustrated wherein a zipper 50 is fitted substantially about the periphery of the rearward portion of the case in interconnecting relation between the top shell 30 and bottom shell 34 of the hard case portion 14. When unzipped, the top shell 30 is movable into an open position thereby facilitating placement and removal of the surfboard 40 within the interior storage compartment 16 of the case such that a forward portion 45 and nose 46 of the surfboard 40 extend into the forward flexible soft case portion 12 between an upper panel 60 and lower panel 62 thereof. Once the surfboard 40 is placed within the interior storage compartment 16, the top shell 30 can be closed and a zipper could be zipped so as to secure the top shell 30 in a closed position relative to the bottom shell 34 thereby fully encapsulating and protecting the tail portion 42 and fins 43 of the surfboard 40.

In the preferred embodiment, the hard case portion is fitted with a foam lining including a thick bed of foam 70 fitted within the bottom shell 34. The bed of foam 70 includes a plurality of slots 72, 72', 72" to accommodate the fins 43 therein, thereby preventing relative movement of the tail portion 42 in fins 43 within the hard case portion 14 of the carry case 10. The foam bed 70 further acts to protect the fins 43 from shock asserted to the exterior of the hard case portion 14 as well as impact to the soft case portion 12 which would cause the surfboard 40 to move within the interior storage compartment 16. With the fins 43 fitted within the slots 72, 72', 72", movement of the surfboard 40 within the interior storage compartment 16 will result in the fins 43 engaging the resilient, shock-absorbent foam bed 70 within the slots 72, 72', 72" thereby preventing damage and possible separation of the fins 43 from the surfboard 40.

Figure 3:
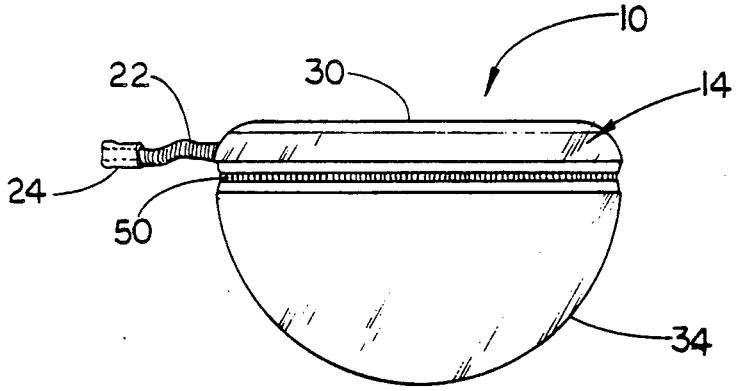
FIG. 3 is an end elevational view of the hard case portion of the preferred embodiment of the present invention.

Referring to FIGS. 3 and 4, it can be seen that the bottom shell 34 is specifically structured and configured so as to clear the fins 43 in encapsulating, surrounding relation thereto. The soft case portion 12 including the upper panels 60 and lower panel 62 are integrally fitted with the top shell 30 and bottom shell 34 of the hard case portion 14 along an interconnecting joint 78. It should be noted that any means of integrally connecting the soft case portion 12 with the hard case portion 14 can be used in order to achieve the desired connection.

Figure 5:
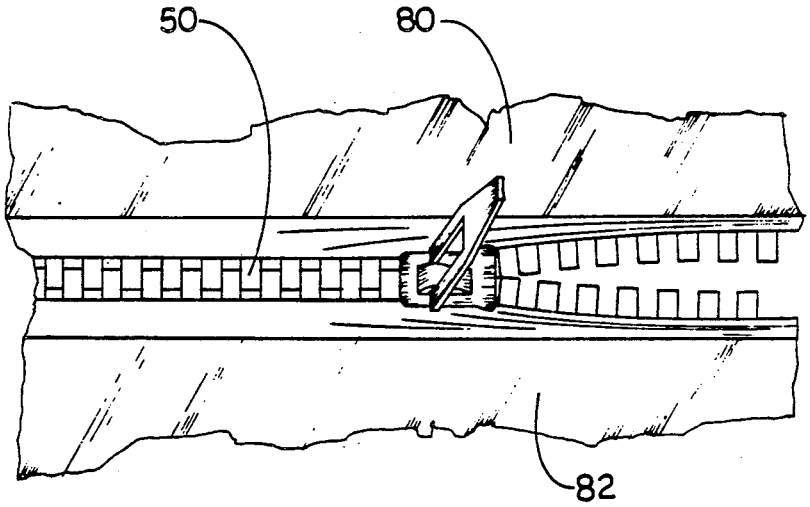
FIG. 5 is an isolated view of the carry case closure means, of the preferred embodiment of the present invention.

The closure means of the present invention, is best illustrated in FIGS. 3 and 5 in which the zipper 50 extends substantially about the periphery of the rearward portion of the case 10 between the top shell 30 and bottom shell 34 of the hard case portion 14. The zipper 50 includes a substantially flexible, yet durable strip of material 82 on opposite sides of the zipper 50 connecting to the top shell 30 and bottom shell 34 respectively. The flexible strips of material 80, 82 provide sufficient flexibility to allow the zipper to be easily manipulated between the open unzipped position and closed zipped position. As best seen in FIGS. 1 and 2, the zipper 50 hooks upwardly at opposite ends 51, 52 to further facilitate opening of the top shell 30 wherein the interconnecting edge 85 between the top shell and upper panel 60 of the soft case portion 12 serves as a hinge permitting swinging movement of the top shell 30 between the open and closed positions.

Figure 7:
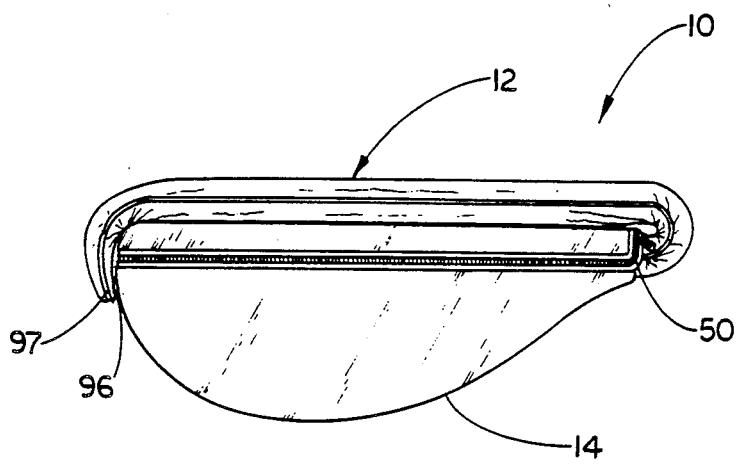
FIG. 7 is a side plan view illustrating the soft case portion folded over in a collapsed position onto the hard case portion of the preferred embodiment of the present invention.
Figure 6:
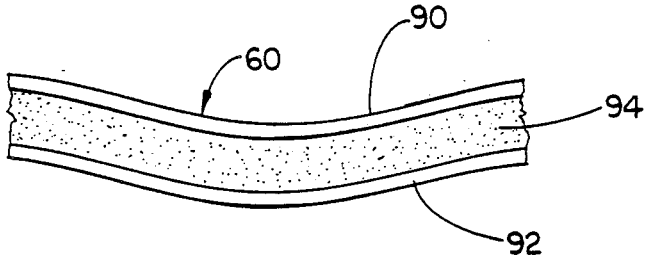
FIG. 6 is a cross-sectional side plan view of the composition of either the upper or lower panel.
Figure 8:
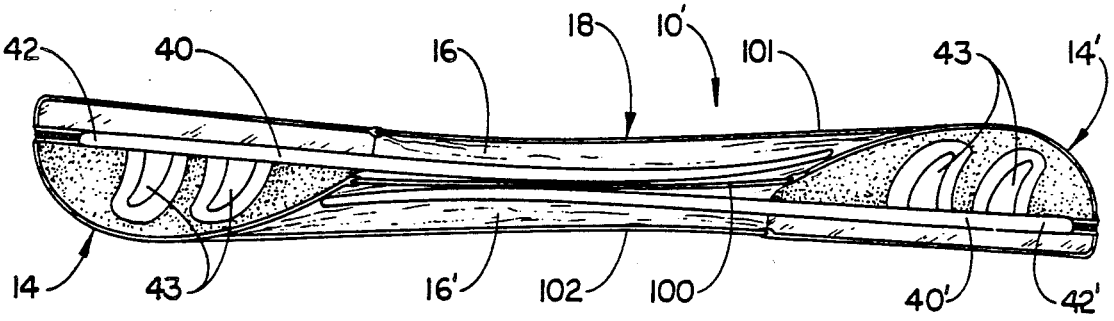
FIG. 8 is a side plan view shown in partial section illustrating an alternative embodiment of the present invention wherein two surfboards are adapted to be carried within the carry case.

As seen in FIG. 6, both the upper panel 60 and lower panel 62 of the soft case portion 12 includes an outer durable nylon lining 90 and inner waterproof lining 92 having a layer of impact resistant foam 94 sandwiched therebetween. The construction of the upper and lower panels 60, 62 of the soft case portion 12 permit the soft case portion 12 to be folded over in a collapsed position onto the hard case portion 14 to maximize the storage efficiency allowing the carry case 10 to be stored conveniently in a minimum amount of space when not in use. A snap 96 can be provided so as to allow the end 97 of the soft case portion 12 to be secured to a tail end of the hard case portion 14 as illustrated in FIG. 7.

In an alternative embodiment of the present invention, the carry case can be structured to facilitate carrying of two surfboards 40, 40' therein wherein the surfboards would preferably be oriented in opposite overlying or side-by-side relation to one another having their tail ends 42, 42' disposed at opposite ends of the case 10' In the alternative embodiment of the carry case 10', two hard case portions 14, 14' are provided at opposite ends of the case for protecting the tail ends 42, 42' and fins 43, 43' of each of the surfboards 40, 40'. The case 10' preferably includes two separate interior storage compartments 16, 16' with a dividing wall 100 extending substantially there between. A mid-section 18 of the case 10' is preferably constructed in a similar manner as the soft case portion 12 of the preferred embodiment having outer panels 101, 102 and interior dividing wall 100 including a sandwiched construction as illustrated in FIG. 6 and described above.

Now that the invention has been described,

What is claimed is:

1. A carry case for carrying a surfboard of the type having at least one fin extending from a tail portion thereof, said case comprising:

a flexible portion including an upper panel and a lower panel structured and disposed to receive a forward portion of a said surfboard therebetween in enclosing, substantially surrounding relation thereto, a rigid portion interconnected to and extending from a proximal end of said flexible portion and including a top shell and a bottom shell structured and disposed to receive the tail portion and at least one fin of a said surfboard therebetween in enclosing, encapsulating, protecting relation thereto, an interior compartment defined between said upper panel and said lower panel of said flexible portion and said top shell and said bottom shell of said rigid portion, said interior compartment being structured and configured for protective storage of a said surfboard therein, access means structured and disposed to facilitate placement and removal of a said surfboard into and out of said interior compartment, said access means being movable between an open position and a closed position relative to said interior compartment, and closure means for securing said access means in said closed position.

2. A carry case as in claim 1 wherein said upper panel and said lower panel of said flexible portion are disposed in surrounding, enclosing relation to a front portion of said interior storage compartment.

3. A carry case as in claim 2 wherein said top shell and said bottom shell of said rigid portion are disposed in surrounding, encapsulating relation to a rear portion of said interior storage compartment.

4. A carry case as in claim 3 wherein said access means is defined by said top shell being movable relative to said bottom shell between an open position and a closed position, thereby facilitating placement and removal of a said surfboard from within said interior compartment.

5. A carry case as in claim 4 wherein said closure means include a zipper fitted substantially about a surrounding periphery of said rigid portion in interconnecting relation between said top shell and said bottom shell whereby opening of said zipper permits movement of said top shell between said open position and said closed position.

6. A carry case as in claim 5 wherein said rigid portion includes a padded foam interior lining.

7. A carry case as in claim 6 wherein said padded foam interior lining includes a foam bed disposed on an interior side of said bottom shell including a plurality of slots structured and disposed for receipt of the fins of a said surfboard therein.

8. A carry case as in claim 7 wherein said upper panel and said lower panel of said flexible portion include an outer nylon lining and an inner waterproof nylon lining having a impact resistant, resilient, flexible foam sandwiched therebetween.

* * * * *